United States Patent [19]

Nakanishi et al.

[11] Patent Number: 4,767,318

[45] Date of Patent: Aug. 30, 1988

[54] CATALYST MOVING STRUCTURE FOR OIL BURNER

[75] Inventors: Yutaka Nakanishi; Toshihiko Yamada; Shigeo Gamou, all of Aichi, Japan

[73] Assignee: Toyotomi Kogyo Co., Ltd., Aichi, Japan

[21] Appl. No.: 23,163

[22] Filed: Mar. 6, 1987

[30] Foreign Application Priority Data

Mar. 11, 1986 [JP] Japan ..... 61-053496

[51] Int. Cl.[4] ..... F23D 3/28

[52] U.S. Cl. ..... 431/304; 431/347; 126/45

[58] Field of Search ..... 126/45; 431/347, 304, 431/307, 308

[56] References Cited

U.S. PATENT DOCUMENTS

| | | | |
|---|---|---|---|
| 564,992 | 8/1896 | Gregory . | |
| 2,646,789 | 7/1953 | Lampert . | |
| 3,381,678 | 5/1968 | Fry . | |
| 4,285,666 | 8/1981 | Burton et al. | 431/347 |
| 4,427,365 | 1/1984 | Kotera et al. | 431/304 |
| 4,498,862 | 2/1985 | Nakamura et al. | 431/317 |

FOREIGN PATENT DOCUMENTS

| | | |
|---|---|---|
| 28916 | 2/1983 | Japan . |
| 10681 | of 1895 | United Kingdom . |
| 1370467 | 10/1974 | United Kingdom . |

*Primary Examiner*—Carroll B. Dority, Jr.

*Attorney, Agent, or Firm*—Pollock, Vande Sande & Priddy

[57] ABSTRACT

A catalyst moving structure for an oil burner capable of facilitating handling of the oil burner in the manufacturing and maintenance as well as covering a combustion gas discharge opening of a combustion cylinder construction of the oil burner when a wick operating shaft is rotated to a fire-extinguishing position, to thereby effectively preventing discharge of bad odor during the fire-extinguishing operation. The catalyst moving structure includes a catalyst moving mechanism including a vertically movable sliding shaft and a connecting rod pivotally mounted on the sliding shaft, a catalyst support member mounted on the sliding shaft, and a movement transmission mechanism including a cam device fitted on the wick operating shaft and a push-up lever operatively connected between the cam device and the connecting rod to transmit actuation of the wick operating shaft to the connecting rod to vertically move the sliding shaft.

9 Claims, 4 Drawing Sheets

CATALYST MOVING STRUCTURE FOR OIL BURNER

BACKGROUND OF THE INVENTION

1. Field of the Invention

This invention relates to a catalyst moving structure for an oil burner, and more particularly to a catalyst moving structure which is adapted to actuate a catalyst so that it may cover a combustion gas discharge opening of an open-type space heater during the fire-extinguishing operation and be kept apart from the opening during the combustion operation.

2. Description of the Prior Art

A conventional open-type oil burner which is adapted to discharge combustion gas directly to a room is constructed to effectively prevent discharge of bad odor to the room during the combustion operation, however, it fails to prevent the discharge during the fire-extinguishing operation. In view of the fact, the inventors proposed a structure which is constructed to close a combustion gas discharge opening of a burner with a cover member having an oxidation catalyst supported thereon. However, in the proposed structure, a catalyst support is mounted on a burner body, resulting in a distance between the burner body and the catalyst support being adversely regulated. Accordingly, in order to space the catalyst support from the burner body at a large distance, it is required to large-size a housing in which the burner body is received. Also, the proposed structure has another disadvantage that when the catalyst support is mounted on the housing, it is required to integrally mount the burner body in the housing, resulting in handling of the oil burner during the manufacturing and maintenance being troublesome.

Accordingly, it would be highly desirable to develop a catalyst moving structure which is capable of facilitating handling of an oil burner during the manufacturing and maintenance while effectively preventing discharge of bad odor during the fire-extinguishing operation.

SUMMARY OF THE INVENTION

Briefly speaking, in accordance with the present invention, a catalyst moving structure for an oil burner including a housing and a burner body received in the housing is provided. The catalyst moving structure includes a catalyst moving mechanism vertically movably mounted on the housing of the oil burner. In a preferred embodiment of the present invention, the catalyst moving mechanism comprises a sliding shaft vertically movably mounted on the housing of the oil burner and a connecting rod pivotally mounted at one end thereof on the sliding shaft. The catalyst moving structure also includes a catalyst support arranged opposite to a combustion gas discharge opening of the oil burner and mounted on the catalyst moving mechanism. The catalyst support is formed into a shape sufficient to carry a catalyst thereon and cover the opening and approachably moved through the catalyst moving mechanism with respect to the opening when the catalyst moving mechanism is vertically moved. Further, the catalyst moving structure includes a movement transmission mechanism arranged on the burner body of the oil burner and operatively connected between the catalyst moving mechanism and a wick operating shaft of the oil burner, which serves to transmit rotations of the wick operating shaft in both wick raising and lowering directions therethrough to the catalyst moving mechanism to upwardly move the catalyst moving mechanism to cover and space the opening with and from the catalyst support, respectively. In a preferred embodiment, the movement transmission mechanism includes a cam means fitted on the wick operating shaft and a push-up lever operatively connected between the cam means and the connecting rod of the catalyst moving mechanism. The catalyst moving mechanism is detachably engaged with the movement transmission mechanism to be mechanically separated therefrom.

Accordingly, it is an object of the present invention to provide a catalyst moving structure for an oil burner which is capable of facilitating handling of the oil burner in the manufacturing and maintenance.

It is another object of the present invention to provide a catalyst moving structure for an oil burner which is capable of allowing a burner body of the oil burner to be removably received in a housing of the oil burner.

It is still another object of the present invention to provide a catalyst moving mechanism for an oil burner which is capable of effectively preventing discharge of bad odor to an exterior of the oil burner during the fire-extinguishing operation.

It is still another object of the present invention to provide a catalyst moving structure for an oil burner which is capable of accomplishing the above-noted objects with a simple construction.

Still other objects and advantages of the invention will in part be obvious and will in part be apparent from the specification.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings in which like reference numerals designate like parts throughout, wherein.

DETAILED DESCRIPTION OF THE PREFERRED EMBODIMENT

Now, a catalyst moving structure for an oil burner according to the present invention will be described hereinafter with reference to the accompanying drawings.

Figure 1:
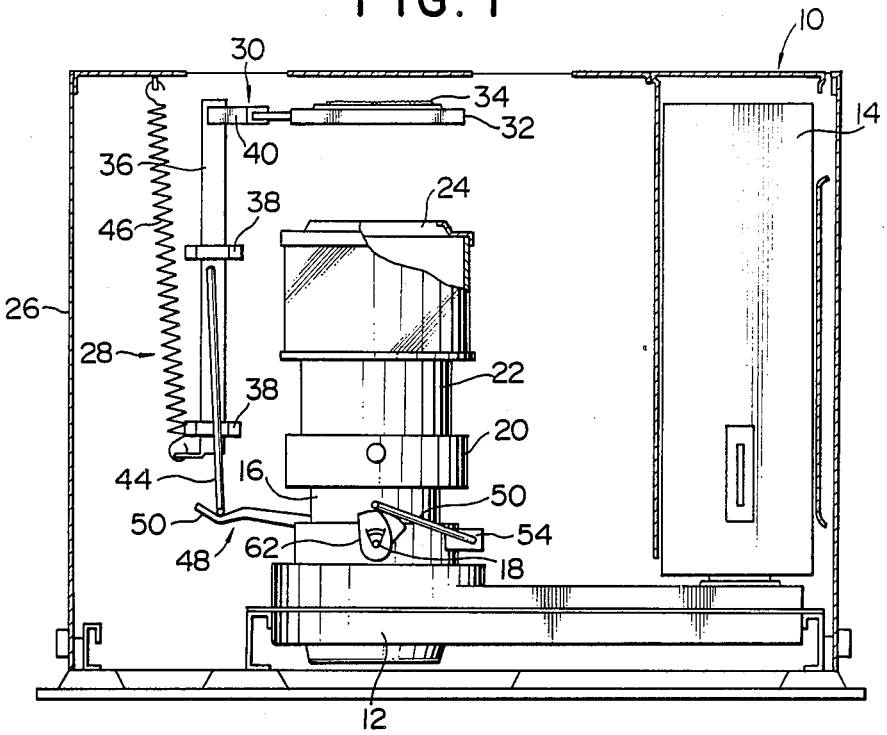
FIG. 1 is a front elevation view showing an example of an oil burner in which a catalyst moving structure according to the present invention is adapted to be incorporated.

FIG. 1 schematically shows an example of an oil burner or oil-fired space heater in which a catalyst moving structure according to the present invention is adapted to be incorporated, in which an oil burner is generally designated by reference numeral 10. The oil burner 10 is in the form of a wick-ignition and open type red-heated oil fired-spaced heater, however, an oil burner to which a catalyst moving structure according to the present invention is not limited to such a heater.

The oil burner 10 itself may be constructed in a manner as widely known in the art. The oil burner 10 includes an oil reservoir 12 for storing fuel oil such as kerosene therein. On the oil reservoir 12 is invertedly supported a cartridge-type oil tank 14 which is communicated with the oil reservoir 12 so as to supply fuel oil therefrom to the oil reservoir 12. Also, on the oil reservoir 12 is arranged a wick receiving construction 16 for vertically movably receiving a wick (not shown) therein. Reference numeral 18 designates a wick operating shaft which is rotatably supported on the wick receiving construction 16 and connected through a wick actuating mechanism (not shown) provided in the wick receiving construction to the wick in a manner widely known in the art, to thereby vertically move the wick through the wick actuating mechanism when it is rotated. The wick actuating mechanism may be constructed in such a manner as disclosed in, for example, U.S. Pat. No. 4,498,862 issued to Kazuharu Nakamura et al on Feb. 12, 1985.

Arranged on the wick receiving construction 16 through a non-permeable cylinder 20 is a combustion cylinder construction 22 which is adapted to carry out combustion of fuel oil vaporized from the wick therein and be red-heated by heat due to the combustion to horizontally radially emit heat rays therefrom to a room. The combustion cylinder construction is formed at a top with an opening 24 through which combustion gas of a high temperature produced in the combustion cylinder construction 22 is upwardly discharged to the room. In the example, the opening 24 is formed into a circular-shape. In the example described above, the oil reservoir 12, wick receiving construction 16, non-permeable cylinder 20 and combustion cylinder construction 22 constitute a burner body of the oil burner 10.

The burner body of the oil burner constructed as described above is received together with the oil tank 14 in a housing 26 of which a front portion is opened and an upper wall is perforated.

A catalyst moving structure of the illustrated embodiment which is incorporated in the oil burner 10 described above is generally indicated by reference numeral 28 in FIG. 1.

Figure 2:
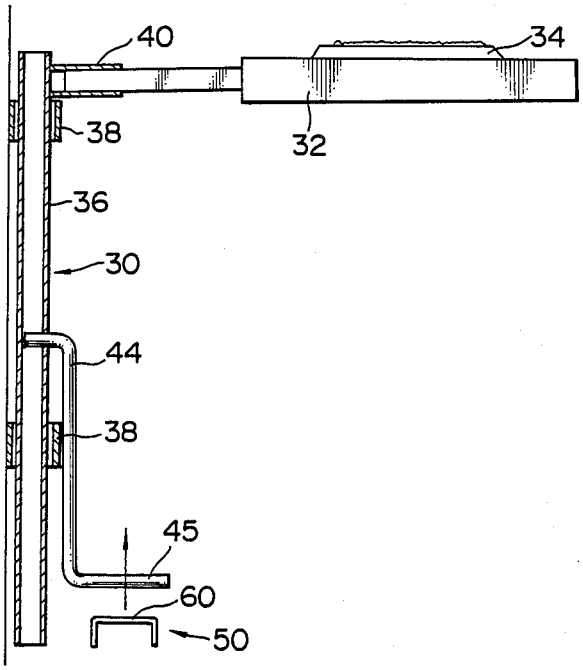
FIG. 2 is a vertical sectional view showing a catalyst moving mechanism.

The catalyst moving structure 28, as shown in FIGS. 1 and 2, includes a catalyst moving section or mechanism generally designated by reference numeral 30. The catalyst moving mechanism or section 30 is adapted to support thereon a catalyst support member 32 which is formed into a shape sufficient to cover the top opening 24 of the combustion cylinder construction 22. In the illustrated embodiment, the catalyst support member 32 is formed into a ring-like shape. On the catalyst support member 32 is arranged a catalyst 34, which, in the illustrated embodiment, is formed into a circular shape so as to be supported through a peripheral portion thereof on the ring-shaped catalyst support member 32. The catalyst 34 is adapted to remove, from combustion gas discharged from the combustion cylinder construction, a smelly component such as unburned fuel oil gas or the like.

The catalyst moving mechanism or section 30 includes a sliding shaft 36 which is vertically movably inserted through a pair of ring-like guide members 38 fixed on the housing 26 in a manner to be vertically spaced from each other, so that it may be vertically movable or slidable through the guide rings 38 with respect to the housing 28 and burner body. In the illustrated embodiment, the above-described catalyst support member 32 is removably connected to the sliding shaft 36 through a connecting member 40 detachably mounted on an upper portion of the sliding shaft 36, so that when the sliding shaft 36 is vertically moved, the catalyst support member 32 may be approachably moved with respect to the combustion gas discharge opening 24 of the combustion cylinder construction 22. This results in the catalyst 34 being vertically moved between an uppermost position in FIG. 1 and a lowermost position in FIG. 2. In addition, the catalyst moving section or mechanism 30 includes a connecting rod 44 pivotally mounted at an upper end thereof on the sliding shaft 36 so as to be pivotal about the upper end. The connecting rod 44 is outwardly bent at a lower end thereof into a substantially L-shape, as indicated at reference numeral 45 in FIG. 2. A weight of the so-constructed catalyst actuating mechanism 28 carrying the catalyst support member 32 thereon is substantially supported by means of a coiled spring 46 which is mounted at an upper end thereof on the housing 26 and connected at a lower end thereof to a lower portion of the sliding shaft 36.

The catalyst moving structure 28 of the illustrated embodiment also includes a movement transmission mechanism section for transmitting rotations of the wick operating shaft 18 in both wick raising and lowering directions to the catalyst moving mechanism 30 to vertically move it, which is generally designated by reference numeral 48 in FIG. 1. The movement transmission mechanism 48 is provided on the burner body side of the oil burner 10 and constructed to be detachably connected to the catalyst moving mechanism 30. Such construction, when the oil burner 10 is assembled to cause the burner body to be removably received in the housing, permits the removal of the burner body from the housing to be carried out without disassembling the catalyst moving structure.

Figure 3:
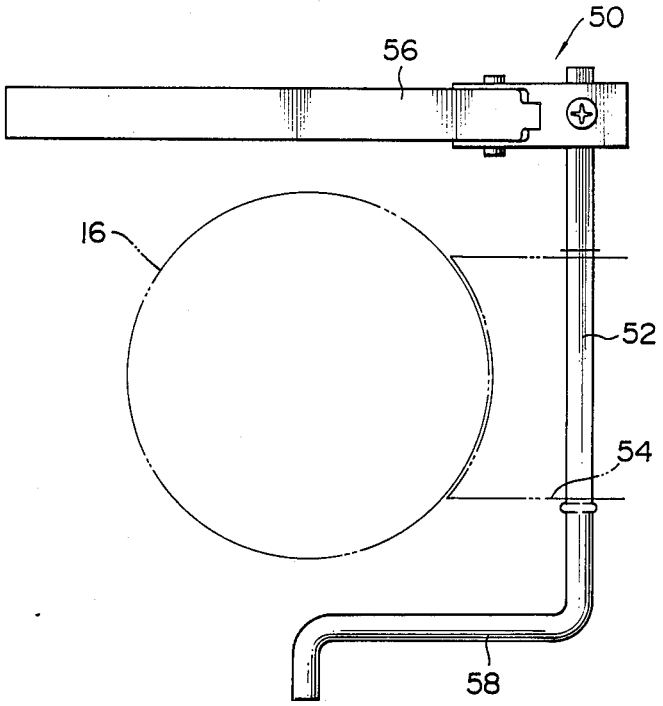
FIG. 3 is a plan view showing a push-up lever.

More particularly, the movement transmission mechanism includes a push-up lever 50 which, as shown in FIG. 3, is formed into a substantially U-shape. More particularly, the push-up lever 50 includes a base or bottom portion 52 which is pivotally mounted on a bearing 54 provided on the wick receiving construction 16, and a push-up portion 56 and an actuation portion 58 opposite to each other with the base portion 52 being interposed therebetween, so that it may be vertically pivotally moved about the base portion 52 in clockwise and couterclockwise directions in FIG. 1. The above-described detachable connection between the catalyst moving mechanism 30 and the movement transmission mechanism is carried out through the connecting rod 44 and the push-up portion 56 of the push-up lever 50. The push-up portion 52 is operatively engaged at a distal end thereof with the lower end 45 of the connecting rod 44 to push up the connecting rod 44. For this purpose, the distal end of the push-up portion 52 is preferably formed into a relatively flat V-shape to constitute a receiving portion 60 which ensures engagement between the connecting rod 44 and the push-up lever 50.

As described above, the connecting rod 44 is pivotally mounted at the upper end on sliding shaft 36 which is vertically slidably mounted through the guide members 38 on the housing 26. Accordingly, even when the lower end 45 of the connecting rod 44 is pivotally moved about the upper end due to actuation of the connecting rod 44 by the push-up portion 56 of the push-up lever 50, the sliding shaft 36 is linearly moved in the vertical direction.

The actuation portion 58 of the push-up lever 50 is engaged with a cam means fittedly mounted on the wick operating shaft 18 so that it may be pivotally actuated about the base portion 52 through the cam means 62 when the wick operating shaft is rotated. In order to ensure engagement between the cam means 62 and the actuation portion 58, the actuation portion is preferably outwardly bent at a distal end thereof so as to be generally formed into an L-shape as shown in FIG. 3.

In the illustrated embodiment, the push-up cam means 62, as best seen in FIG. 5, comprises a stationary cam 64 fixed on the wick operating shaft 18 and a movable cam 66 movably superposed on a rear surface of the stationary cam 64. In the illustrated embodiment, the movable shaft is movably fitted on the shaft 18. Between the stationary cam 64 and the movable cam 66 is interposedly arranged a V-shaped spring or engagement spring 68 which is wound on the wick operating shaft 18 and through which both cams are operatively engaged with or connected to each other. More particularly, as shown in FIG. 5, the stationary cam 64 is formed with an arcuate slit 70 in which the engagement spring 68 is operatively arranged, and the spring 68 is held at one end thereof on the stationary cam 64 and at the other end thereof on a stopper 72 of the movable cam 66 through the slit 70, so that the movable cam 66 is adapted to be pivotally moved with respect to the stationary cam 64 about the shaft 18 against the engagement spring 68. The stationary cam 64 is formed into a substantially elliptic shape to have a gentle configuration section 74 and a steep configuration section 76 defined by a maximum radius section and contiguous to the gentle cam configuration section 74, whereas the movable cam 66 is formed into a substantially sector shape. Also, the stationary cam 64 and movable cam 66 are formed to have substantially the same maximum radius, and superposition of the movable cam 66 on the stationary cam 64 is carried out through the engagement spring 68 in a manner such that the maximum radius section of the movable cam 66 substantially positionally corresponds to that of the stationary cam 64. Further, in the illustrated embodiment, elastic force of the engagement spring 68 is defined to have a magnitude sufficient to cause the spring 68 to be compressed due to abutment of the push-up lever 50 against the movable cam 66 during rotation of the wick operating shaft 18 in the wick raising direction, to thereby render the movable cam stationary during the rotation.

As described above, the cam means 62 comprises the stationary cam 64 having the gentle configuration section 74 and the movable cam 66 superposedly arranged on the stationary cam 64 and the V-shaped engagement spring 68 is interposed between both cams to operatively connect them to each other, so that when the wick operating shaft 18 is rotated in the wick raising direction, the push-up lever 50 may be actuated by the stationary cam 64, whereas the shaft 18 is rotated in the wick lowering direction or fire-extinguishing direction, the lever 50 may be actuated by the movable cam 66.

Figure 4:
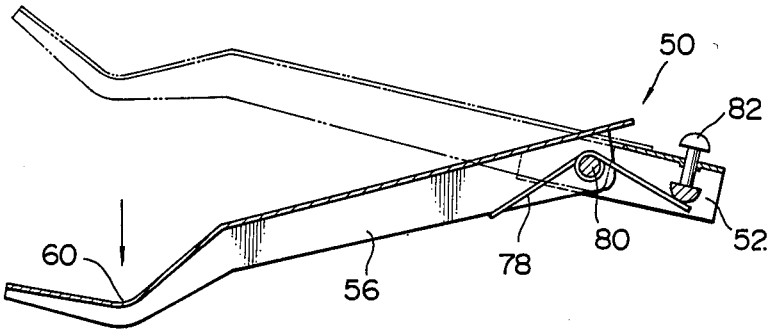
FIG. 4 is a sectional view showing the manner of connection between a push-up portion of a push-up lever and a base portion thereof.

In the illustrated embodiment, the push-up portion 56 of the push-up lever 50 is vertically pivotally connected to the base portion 52, as shown in FIG. 4. More particularly, the push-up portion 56 is connected to the base portion 52 through a pivot pin 80 and upwardly forced by means of an inverted V-shaped push-up spring 78 mounted on the pin 80 and engaged with one end thereof with the push-up portion 56 and at the other end with a holding pin 82 provided at the base portion 52, so that normally it may be straightly aligned with the base portion 52 as indicated at phantom lines in FIG. 4. Such construction, when the push-up lever 50 is rapidly rotated about the base portion 52 by means of the cam means 62, allows the push-up portion 56 of the push-up lever 50 to be pivotally moved about the pin 80 as indicated at solid lines in FIG. 4 followed by being straightly aligned with the base portion 52 by the spring 78, to thereby prevent compulsory force from being applied to the sliding shaft 36.

Now, the manner of operation of the catalyst moving structure of the illustrated embodiment constructed as described above will be generally described hereinafter.

Rotation of the wick operating shaft 18 of the oil burner 10 in the wick raising direction or the clockwise direction in FIG. 1 causes the push-up lever 50 to be pivotally moved following a configuration of the push-up cam means 62 about the base portion 52 supported on the bearing 54, because the actuation portion 58 of the push-up lever 50 is contacted with the push-up cam means 62. The push-up portion 56 of the push-up lever 50 is operatively engaged at the distal end thereof with the connecting rod 44 to the sliding shaft 36, and the catalyst support member 32 which covers the combustion gas discharge opening 24 of the combustion cylinder construction 22 and on which the catalyst 34 is carried is mounted on the upper end of the sliding shaft 36, so that the above-described pivotal movement of the push-up lever 50 may cause the sliding shaft 36 to be upwardly moved to keep the catalyst support member apart from the opening 24 as shown in FIG. 1, resulting in the burner 10 carrying out ignition and combustion without being affected by the catalyst support member 32 and catalyst 34.

Subsequently, rotation of the wick operating shaft 18 in the the fire-extinguishing direction or the counterclockwise direction in FIG. 1 to lower the wick to the lowermost position causes fire-extinguishing of the oil burner 10 to be carried out and the cam means 62 to pivotally move the push-up lever 50 about the base portion 52 in the counterclockwise direction in FIG. 1 to lower the sliding shaft 36 through the connecting rod 44, so that the catalyst support member 32 mounted on the sliding shaft 36 may be lowered to cover the opening 24 of the combustion cylinder construction 22. Thus, combustion gas remaining in the combustion cylinder construction 22 and containing incomplete combustion gas, vaporized fuel oil and the like is upwardly discharged through the catalyst 34, during which the catalyst removes a smelly component from the gas, resulting in discharge of bad odor to a room being effectively prevented.

Now, the operation of the transmission section 48 of the catalyst actuating mechanism will be more detailedly described hereinafter with reference to FIGS. 5A to 5D.

Figure 5A:
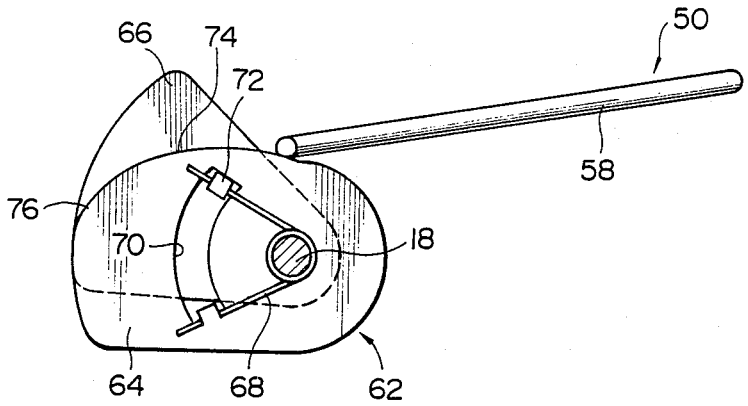
FIGS. 5A to 5D each are a schematic view showing a relationship of actuation between a cam means and a push-up lever.
Figure 5B:
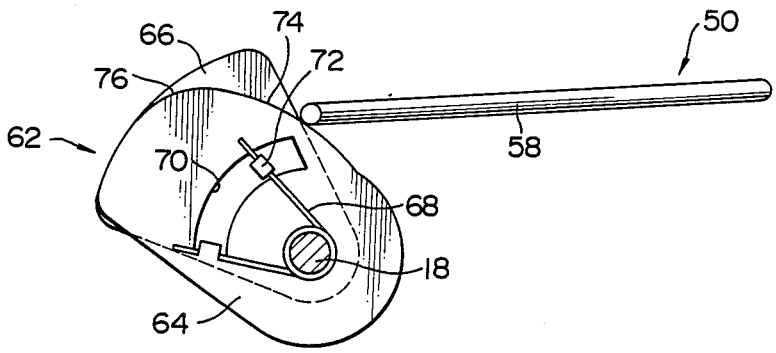
Figure 5C:
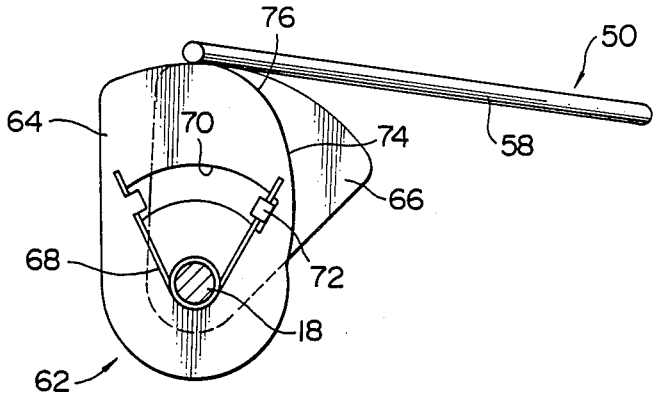

FIG. 5A shows a fire-extinguishing position of the cam means 62 where the wick (not shown) is lowered to a lowermost position and the actuation portion 58 of the push-up lever 50 is contacted with a portion of the stationary cam 64 apart from the gentle configuration section 74. When the wick operating shaft 18 is rotated in the wick raising direction or in the clockwise direction in FIG. 5A, the stationary cam 64 is rotated with the shaft 18 to cause the actuation portion 58 of the push-up lever 50 to be contacted with the gentle configuration section 74 of the stationary cam 64 and start contact with the movable cam 66, and further rotation of the wick operating shaft 18 in the clockwise direction causes the actuation portion 58 of the push-up lever 56 to push down the movable cam 66 against the V-shaped engagement spring 68, as shown in FIG. 5B, so that it may be upwardly pivotally moved by the gentle configuration section 74 of the stationary cam 64 while being contacted with the section 74. Then, when the wick operating shaft 18 is further rotated in the clockwise direction to raise the wick to the uppermost position or combustion position, the actuation portion 58 of the push-up lever 50 is engaged with the steep configuration section 76 of the stationary cam 64 to be pivotally raised to its uppermost position. This results in the push-up lever 50 failing to further press the movable cam 66 against the V-shaped engagement spring 68, so that the movable cam 66 may be rotated in the clockwise direction by the V-shaped engagement spring 68 to return to its original position with respect to the stationary cam 64 at which the stopper 72 is abutted against the stationary cam 64, as shown in FIG. 5C. This causes the push-up portion 56 of the push-up lever 50 of the movement transmission mechanism 48 to push up the connecting rod 44 to upwardly move the sliding shaft 36 of the catalyst moving mechanism 30, to thereby upwardly keep the catalyst 34 apart from the opening 24 of the combustion cylinder construction 22. This results in the catalyst moving structure 28 being at the position shown in FIG. 1 for ignition which may be carried out in a conventional manner.

Figure 5D:
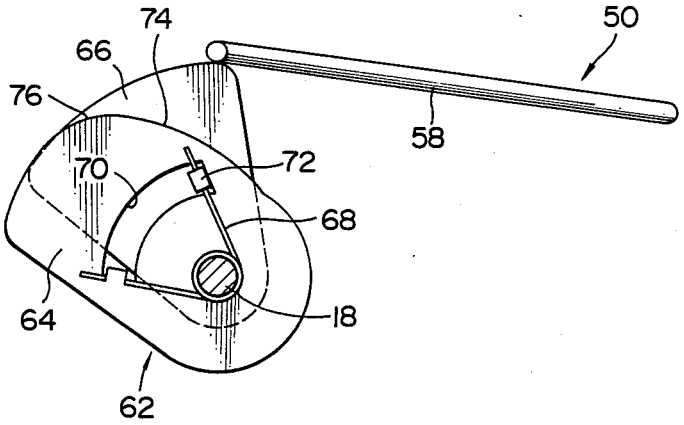

Then, the wick operating shaft 18 is rotated in the counterclockwise direction for fire-extinguishing, the actuation portion 58 of the push-up lever 50 follows the configuration of the movable cam 66 to be returned to its original position shown in FIG. 5A through a position shown in FIG. 5D.

As can be seen from the foregoing, the catalyst moving structure of the present invention is so constructed that the combustion gas discharge opening of the oil burner is covered by the catalyst support member in association with the fire-extinguishing operation. Thus, combustion gas containing a smelly component which is generated during the fire-extinguishing operation is discharged through the catalyst carried on the catalyst support member to a room, resulting in discharge of the smelly component to the room being effectively prevented. Also, the catalyst moving mechanism is rigidly mounted on the housing of the oil burner, so that the catalyst support member may securely cover the combustion gas discharge opening of the oil burner.

In addition, in the catalyst moving structure of the present invention, the movement transmission mechanism is provided on the burner body of the oil burner separate from the housing and detachably connected to the catalyst moving mechanism, so that the catalyst support member may be effectively actuated even when any error occurs during mounting of the burner body in the housing.

It will thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all the generic and specific features of the scope of the invention which, as a matter of language, might be said to fall therebetween.

What is claimed is:

1. A catalyst moving structure for an oil burner having a housing, a burner body received in said housing, a wick for burning oil in said burner body, and means for raising and lowering said wick including a rotatable wick operating shaft, said structure comprising:

a catalyst means;

a catalyst support means arranged opposite to a combustion gas discharge opening of said oil burner, said catalyst support means supporting said catalyst means and having a shape sufficient to cover said opening and cause combustion gas from said oil burning in said burner body to be passed from said covered opening through said catalyst means;

a moving means comprising a moving mechanism and mounting means for movably mounting said moving mechanism on said housing, said catalyst support means being mounted on said moving mechanism to be approachably moved with respect to said opening when said moving mechanism is moved; and a movement transmission mechanism arranged on said burner body of said oil burner and operatively connected between said moving mechanism and said wick operating shaft oil burner, said movement transmission mechanism transmitting rotations of said wick operating shaft in both wick raising and lowering directions to said moving mechanism to move said moving mechanism so that said catalyst support means is spaced from said opening and covers said opening, respectively.

2. A catalyst moving structure as defined in claim 1, wherein said catalyst support means is detachably mounted on said moving mechanism.

3. A catalyst moving structure as defined in claim 1, wherein said moving mechanism comprises a sliding shaft and a connecting rod pivotally mounted at one end thereof on said sliding shaft, and said mounting means comprises means for mounting said sliding shaft on said housing for vertical movement.

4. A catalyst moving structure as defined in claim 3, wherein said movement transmission mechanism comprises a cam means fitted on said wick operating shaft and a push-up lever actuated by said cam means to be vertically pivotally moved and operatively connected to said moving mechanism.

5. A catalyst moving sturcture as defined in claim 4, wherein said moving mechanism is detachably connected to said movement transmission mechanism.

6. A catalyst moving structure as defined in claim 4, wherein said push-up lever is formed into a substantially U-shape to have a base portion pivotally mounted on said burner body of said oil burner, an actuation portion actuated by said cam means, and a push-up portion operatively engaged with said connecting rod, said base portion being interposed between said actuation portion and said push-up portion.

7. A catalyst moving structure as defined in claim 6, wherein said base portion and actuation portion are integrally formed together, and said push-up portion is pivotally connected to said base portion with a spring being interposed therebetween which normally forces said push-up portion to straightly align said push-up portion and base portion with each other.

8. A catalyst moving mechanism as defined in claim 4, wherein said cam means comprises a stationary cam fixed on said wick operating shaft, a moving cam superposed on said stationary cam so as to be movable with respect to said stationary cam, and an engagement spring interposed between said stationary cam and said movable cam to engage both cams with each other;

said movable cam compressing said engagement spring to cause said stationary cam to pivotally push up said push-up lever when said wick operating shaft is rotated in the wick raising direction, being returned to the original position with respect to said stationary cam by said engagement spring when a wick is raised to an uppermost position, and causing said push-up lever to be pivotally lowered when said wick operating shaft is rotated in the wick lowering direction to lower said wick from said uppermost position.

9. A catalyst moving structure for an oil burner having a housing, a burner body received in said housing and including combustion cylinder construction, a wick for burning oil in said burner body, and means for raising and lowering said wick including a rotatable wick operating shaft, said structure comprising:

a moving means comprising a sliding shaft, means for mounting said sliding shaft on said housing for vertical movement, and a connecting rod pivotally mounted at an upper end thereof on said sliding shaft so as to be pivotally moved about the upper end;

a catalyst means;

a catalyst support member arranged opposite to a combustion gas discharge opening of said combustion cylinder construction of said oil burner, said catalyst support member supporting said catalyst means and having a shape sufficient to cover said opening and cause combustion gas from said oil burning in said burner body to be passed from said covered opening through said catalyst means, and said catalyst support being mounted on said sliding shaft of said member moving means so as to be approachably moved with respect to said opening when said sliding shaft is vertically moved; and a movement transmission mechanism comprising a cam means fitted on said wick operating shaft and a push-up lever pivotally mounted on said burner body and operatively connected between said cam means and said connecting rod of said moving means, said cam means transmitting rotations of said wick operating shaft in both wick raising and lowering directions therethrough to said push-up lever to pivotally vertically move said push-up lever such that said sliding shaft is moved vertically through engagement between said push-up lever and said connecting rod.

* * * * *

UNITED STATES PATENT AND TRADEMARK OFFICE

CERTIFICATE OF CORRECTION

PATENT NO. :4,767,318

DATED :August 30, 1988

INVENTOR(S) :Yutaka Nakanishi, et al.

It is certified that error appears in the above-identified patent and that said Letters Patent is hereby corrected as shown below:

In column 8, line 31, after "shaft" insert --of said--.

In column 8, line 53, change "sturcture" to --structure--.

In column 9, line 23, after "including" insert --a--.

Signed and Sealed this

Third Day of January, 1989

*Attest:*

DONALD J. QUIGG

*Attesting Officer*

*Commissioner of Patents and Trademarks*